US010249234B2

(12) United States Patent
Kim

(10) Patent No.: US 10,249,234 B2
(45) Date of Patent: Apr. 2, 2019

(54) DATA DRIVING APPARATUS AND DISPLAY DEVICE USING THE SAME

(71) Applicant: SAMSUNG DISPLAY CO., LTD., Yongin-si, Gyeonggi-Do (KR)

(72) Inventor: Chang Sin Kim, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 197 days.

(21) Appl. No.: 15/137,445

(22) Filed: Apr. 25, 2016

(65) Prior Publication Data

US 2017/0092188 A1 Mar. 30, 2017

(30) Foreign Application Priority Data

Sep. 25, 2015 (KR) ..... 10-2015-0136650

(51) Int. Cl.
*G09G 3/20* (2006.01)

(52) U.S. Cl.
CPC ... *G09G 3/2096* (2013.01); *G09G 2300/0413* (2013.01); *G09G 2310/0275* (2013.01);
(Continued)

(58) Field of Classification Search
CPC ..... G09G 3/2096; G09G 2310/0275; G09G 2370/08; G09G 2340/0421;
(Continued)

(56) References Cited

U.S. PATENT DOCUMENTS 7,663,591 B2 * 2/2010 Sasaki ..... G09G 3/3644 345/100
7,782,312 B2 * 8/2010 Cho ..... G09G 3/3688 345/100

(Continued)

FOREIGN PATENT DOCUMENTS

KR 1020050058179 6/2005
KR 1020050058179 A2 * 6/2005 ..... G02F 1/133

(Continued)

*Primary Examiner* — Grant Sitta
(74) *Attorney, Agent, or Firm* — F. Chau & Associates, LLC

(57) ABSTRACT

A data driver according to an exemplary embodiment includes a plurality of first output channels, a plurality of second output channels, a data controller and a data driving integrated circuit IC. The plurality of first output channels are connected to a plurality of data lines. The data controller receives an image data signal and a data control signal. The data controller generates an image data of one frame unit according to the image data signal and the data control signal. The data controller generates an output channel on/off data based on channel selection data. The data driving IC generates a plurality of data signals and a plurality of dummy signals according to the image data of one frame unit. The data driving IC switches a plurality of first switches transmitting the plurality of data signals to the plurality of first output channels and a plurality of second switches transmitting the plurality of dummy signals to the plurality of second output channels. The image data signal includes the channel selection data, the plurality of first output channels and the plurality of second output channels.

17 Claims, 10 Drawing Sheets

(52) U.S. Cl.
CPC ..... *G09G 2310/0286* (2013.01); *G09G 2320/0209* (2013.01); *G09G 2340/0421* (2013.01); *G09G 2370/08* (2013.01)

(58) Field of Classification Search
CPC ... G09G 2320/0209; G09G 2310/0286; G09G 2300/0413
See application file for complete search history.

(56) References Cited

U.S. PATENT DOCUMENTS 7,956,836 B2 * 6/2011 Yamazaki ..... G09G 3/3685 345/100
8,963,822 B2 * 2/2015 Yoon ..... G09G 3/3614 345/100
2006/0114217 A1 * 6/2006 Kim ..... G09G 3/20 345/100
2008/0094342 A1 * 4/2008 Kim ..... G09G 3/3611 345/99
2008/0284758 A1 * 11/2008 Lee ..... G09G 3/3688 345/204
2009/0303225 A1 * 12/2009 Kang ..... G09G 3/20 345/213
2011/0037871 A1 * 2/2011 Suzuki ..... H04N 5/378 348/222.1
2011/0310074 A1 * 12/2011 Ochiai ..... G09G 3/3674 345/208
2014/0063023 A1 * 3/2014 Baek ..... G09G 1/00 345/501
2014/0198086 A1 * 7/2014 Cheng ..... G09G 3/20 345/209
2014/0312908 A1 * 10/2014 Lemons ..... G09G 3/006 324/414
2014/0361960 A1 * 12/2014 Yamauchi ..... G09G 3/3233 345/76
2015/0325193 A1 * 11/2015 Chang ..... G09G 3/3688 345/698
2016/0104409 A1 * 4/2016 Jeon ..... G09G 3/3225 345/690
2016/0189644 A1 * 6/2016 So ..... G09G 3/3233 345/205

FOREIGN PATENT DOCUMENTS

KR 1020120075762 7/2012
KR 1020140045192 4/2014
KR 1020150026000 3/2015

* cited by examiner

▮ Dummy output channel

▯ Normal output channel

▮ Dummy output channel

▯ Normal output channel

DATA DRIVING APPARATUS AND DISPLAY DEVICE USING THE SAME

RELATED APPLICATION

This application claims priority to and the benefit of Korean Patent Application No. 10-2015-0136650 filed in the Korean Intellectual Property Office on Sep. 25, 2015, the entire contents of which are herein incorporated by reference.

TECHNICAL FIELD

An exemplary embodiment of the described technology relates generally to a data driving apparatus and a display device using the data driving apparatus.

DISCUSSION OF RELATED ART

In general, a display device includes a display panel displaying an image, and a driving circuit connected with the display panel and supplying signals for displaying an image to the display panel. The display panel includes a plurality of pixels connected to a plurality of scan lines, a plurality of data lines, and the corresponding signal lines. In addition, the driving circuit includes a scan driver supplying a scan signal through a scan line and a data driver supplying a data signal through a data line.

Depending on a resolution of the display panel, a portion of the channels output from one data integrated circuit IC included in the data driver may not be used. For example, depending on a resolution of the display panel, a data IC having 966 channels outputs a data signal only through 270 channels, and 246 other channels are dummy output channels that are not connected to the display panel.

The dummy output channels are asymmetrically formed, and thus the fan-out wires of the display panel connected to the normal output channels may not have substantially the same resistance. Further, a signal output from a dummy output channel may introduce noise to a signal output from a normal channel and may cause additional power consumption.

SUMMARY

According to an exemplary embodiment a data driver includes a plurality of first output channels, a plurality of second output channels, a data controller and a data driving integrated circuit IC. The plurality of first output channels are connected to a plurality of data lines. The data controller receives an image data signal and a data control signal. The data controller generates an image data of one frame unit according to the image data signal and the data control signal. The data controller generates an output channel on/off data based on channel selection data. The data driving IC generates a plurality of data signals and a plurality of dummy signals according to the image data of one frame unit. The data driving IC switches a plurality of first switches transmitting the plurality of data signals to the plurality of first output channels and a plurality of second switches transmitting the plurality of dummy signals to the plurality of second output channels. The image data signal includes the channel selection data, the plurality of first output channels and the plurality of second output channels.

In an exemplary embodiment, the channel selection data may include information for arranging the plurality of first output channels and the plurality of second output channels.

In an exemplary embodiment, the data driving IC may include a first latch, a second latch and a digital-analog converter. The first latch may latch the image data of one frame unit to at least one channel unit and outputs a latched image data. The second latch may latch the output channel on/off data and outputs a latched output channel on/off data to the plurality of second switches. The digital-analog converter may convert the latched image data into the plurality of data signals and the plurality of dummy signals. The digital-analog converter may output the plurality of data signals and the plurality of dummy signals, and including the plurality of first switches.

In an exemplary embodiment, the data driving IC may further include an output buffer that buffers and outputs the plurality of data signals and the plurality of dummy signals, and including the plurality of second switches.

In an exemplary embodiment, the plurality of second switches may be driven to not output the plurality of dummy signals according to the output channel on/off data transmitted from the second latch.

In an exemplary embodiment, the data driving IC may further include a first shift register and a second shift register. The first shift register outputs a first sampling signal to the first latch. The second shift register outputs a second sampling signal. An enable period is different from that of the first sampling signal to the second latch.

In an exemplary embodiment, the enable period of the first sampling signal and the enable period of the second sampling signal may be determined according to a number of the first output channel and the second output channel.

In an exemplary embodiment, the data driving IC may further include a shift register that outputs a sampling signal to the first latch and the second latch, and the first latch and the second latch may perform latching for each channel.

According to an exemplary embodiment, the display device includes a display unit, a data driver and a signal controller. The display unit includes a plurality of pixels, each pixel is connected to a corresponding data line among a plurality of data lines. The data driver generates a plurality of data signals transmitted to a plurality of first output channels connected to the plurality of data lines and a plurality of dummy signals transmitted to a plurality of second output channels. The signal controller outputs an image data signal including channel selection data related to the plurality of first output channels and the plurality of second output channels and a data control signal to the data driver.

In an exemplary embodiment, the signal controller may generate image data based on an input image information and arranged image data for each pixel unit. The signal controller may generate the image data signal by locating dummy image data in the plurality of pixels corresponding to the plurality of second output channels according to the channel selection data.

In an exemplary embodiment, the signal controller may output the image data signal. The channel selection data is arranged prior to the image data and the dummy image data.

In an exemplary embodiment, the data driver may include a data controller and a data driving integrated circuit IC. The data controller receives the image data signal and the data control signal. The data controller generates image data for one frame unit and outputs channel on/off data based on the channel selection data included in the image data signal. The data driving IC generates the plurality of data signals and the plurality of dummy signals according to the image data of one frame unit, and switching a plurality of first switches transmitting the plurality of data signals to the plurality of first output channels and a plurality of second switches transmitting the plurality of dummy signals to the plurality of second output channels.

In an exemplary embodiment, the channel selection data may include information for arranging the plurality of first output channels and the plurality of second output channels.

In an exemplary embodiment, the data driving IC may include a first latch, a second latch and a digital-analog converter. The first latch may latch the image data for one frame unit to at least one channel unit. The first latch may output the latched image data. The second latch may latch the output channel on/off data. The second latch may output the latched output channel on/off data to the plurality of first switches and the plurality of second switches. The digital-analog converter may convert latched image data output from the first latch to the plurality of data signals and the plurality of dummy signals and outputs the plurality of data signals and the plurality of dummy signals, and including the plurality of first switches.

In an exemplary embodiment, the data driving IC may further include an output buffer that buffers and outputs the plurality of data signals and the plurality of dummy signals, and including the plurality of first switches and the plurality of second switches.

In an exemplary embodiment, the plurality of second switches may be driven to not output the plurality of dummy signals according to the output channel on/off data transmitted from the second latch.

In an exemplary embodiment, the data driving IC may further include a first shift register and a second shift register. The first shift register may output a first sampling signal to the first latch. The second shift register may output a second sampling signal of which an enable period is different from that of the first sampling signal to the second latch.

In an exemplary embodiment, the enable period of the first sampling signal and the enable period of the second sampling signal may be determined according to a number of the first output channels and the second output channels.

In an exemplary embodiment, the data driving IC may further include a shift register that outputs a sampling signal to the first latch and the second latch, and the first latch and the second latch may perform latching for each channel.

According to an exemplary embodiment, a display device may include a display unit, a signal controller and a data driver. The display unit may include a plurality of pixels, each pixel is connected to a corresponding data line among a plurality of data lines. The signal controller that outputs an image data signal. The data driver generates a plurality of data signals transmitted to a plurality of first output channels connected to the plurality of data lines and a plurality of dummy signals transmitted to a plurality of second output channels. The image data signal includes a channel data and image data for one frame unit.

In an exemplary embodiment, the channel data may include a configuration channel mode and an output channel on/off data. The configuration channel mode indicates the amount of first output channels and second output channels for a resolution of the display unit. The output channel on/off data activates or deactivates switches corresponding to the plurality of first output channels and the plurality of second output channels.

In an exemplary embodiment, the data driving IC may include a first latch, a second latch and a digital-analog converter. The first latch may latch the image data of one frame unit to at least one channel unit and outputs a latched image data. The second latch may latch the output channel on/off data and outputs a latched output channel on/off data to the plurality of second switches. The digital-analog converter may convert the latched image data into the plurality of data signals and the plurality of dummy signals. The digital-analog converter may output the plurality of data signals and the plurality of dummy signals, and including the plurality of first switches.

In an exemplary embodiment, the display device may further include an output buffer that buffers and outputs the plurality of data signals and the plurality of dummy signals, and including the plurality of second switches.

BRIEF DESCRIPTION OF THE DRAWINGS

The above and other features of the present inventive concept will become more apparent by describing in detail exemplary embodiments thereof with reference to the accompanying drawings.

DETAILED DESCRIPTION

Figure 1:
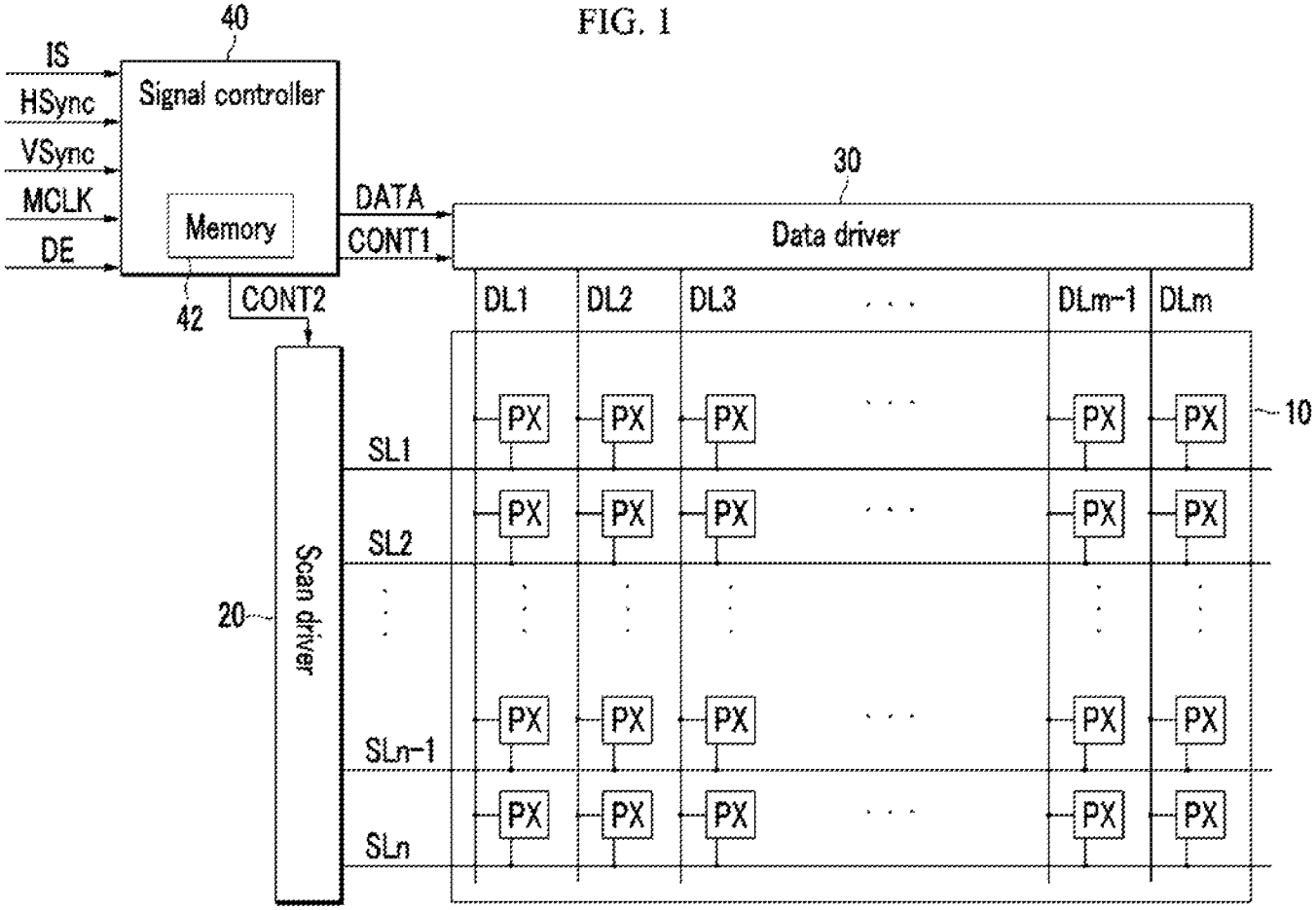
FIG. 1 is a block diagram schematically illustrating a display device according to an exemplary embodiment.

The exemplary embodiments of the present invention will be described more fully hereinafter with reference to the accompanying drawings, in which exemplary embodiments of the invention are shown. As those skilled in the art would realize, the described embodiments may be modified in various ways without departing from the spirit or scope of the present invention.

Accordingly, the drawings and description are to be regarded as illustrative in nature and not restrictive. Like reference numerals designate like elements throughout the specification.

FIG. 1 is a block diagram schematically illustrating a configuration of a display device according to an exemplary embodiment.

Referring to FIG. 1, a display device includes a display unit 10 including a plurality of pixels PX, a scan driver 20, a data driver 30, and a signal controller 40.

The display unit 10 includes a plurality of pixels, each connected to a corresponding scan line among a plurality of scan lines SL1 to SLn and a corresponding data line among a plurality of data lines DL1 to DLm. Each of the plurality of pixels PX displays an image corresponding to a data signal transmitted thereto.

The plurality of pixels PX included in the display unit 10 are respectively connected to the plurality of scan lines SL1 to SLn and the plurality of data lines DL1 to DLm and substantially arranged in a matrix format. The plurality of scan lines SL1 to SLn are extended in substantially a horizontal direction and substantially parallel with each other. The plurality of data lines DL1 to DLm are extended in substantially a vertical direction and substantially parallel with each other.

The scan driver 20 is connected to the display unit 10 through the plurality of scan lines SL1 to SLn. The scan driver 20 generates a plurality of scan signals that can activate the respective pixels PX of the display unit 10 according to a scan control signal CONT2, and transmits the scan signal to the corresponding scan line among the plurality of scan lines SL1 to SLn.

The scan control signal CONT2 is an operation control signal of the scan driver 20, and is generated and transmitted from the signal controller 40. The scan control signal CONT2 may include a scan start signal, a clock signal, and the like. The scan start signal is a signal that generates the first scan signal for displaying an image of one frame. The clock signal is a synchronization signal for applying a scan signal to the plurality of scan lines SL1 to SLn.

The data driver 30 is connected with the respective pixels PX of the display unit 10 through the plurality of data lines DL1 to DLm. The data driver 30 receives an image data signal DATA, and transmits a data signal to the corresponding data line among the plurality of data lines DL1 to DLm according to the data control signal CONT1.

The data control signal CONT1 is an operation control signal of the data driver 30, and is generated and transmitted from the signal controller 40. The data control signal CONT1 may include a load signal for application of a data signal to a data line and a plurality of data clock signals, each having a different cycle. The data driver 30 selects a gray voltage according to the image data signal DATA and transmits the selected gray voltage as a data signal to the plurality of data lines DL1 to DLm.

The signal controller 40 receives image information IS input from an external source and an input control signal controlling displaying of the image information. The image information IS contains luminance information of each pixel PX of the display unit 10, and luminance may be determined by a plurality of grays.

The input control signal transmitted to the signal controller 40 exemplarily includes a vertical synchronization signal VSync, a horizontal synchronizing signal HSync, a main clock signal MCLK, a data enable signal DE, and the like.

The signal controller 40 processes the input image information IS to meet an operating condition of the display unit 10 and the data driver 30 based on input image signal IS, channel selection data stored in a memory 42, and the input control signal. For example, the channel selection data includes information for selective driving of an output channel of the data driver 30 according to a resolution of the display unit 10. For example, the channel selection data may include a plurality of normal output channels connected to the plurality of data lines DL1 to DLm and dummy output channels that are not connected with the plurality of data lines among the output channels. Further, the channel selection data may include the sequence and format with which the plurality of normal output channels and the plurality of dummy output channels are arranged together.

The signal controller 40 generates image data based on the image information IS, and may generate an image data signal DATA by arranging image data according to the channel selection data. For example, when arranging the image data with a pixel unit, the signal controller 40 may generate the image data signal DATA by locating dummy image data based on a pixel corresponding to a dummy output channel according to the channel selection data.

The signal controller 40 generates dummy image data that indicates a dummy signal output through a dummy output channel of a data driving integrated circuit (IC). The signal controller 40 arranges image data that indicates a data signal output through a normal output channel of the data driver IC according to the channel selection data.

After arranging the dummy image data and the image data, the signal controller 40 may apply image processing such as gamma correction, luminance compensation, and the like to the image data signal DATA. In a further example, after applying the image processing to the image data, the signal controller 40 may generate the image data signal DATA by arranging the dummy image data and the image-processed image data.

The signal controller 40 transmits a scan control signal CONT2 that controls operation of the scan driver 20 to the scan driver 20. The signal controller 40 generates a data control signal CONT1 that controls the operation of the data driver 30. The signal controller 40 transmits the data control signal CONT1 with the image data signal DATA that has been subjected to image processing, to the data driver 30. For example, the image data signal DATA includes channel selection data.

The data driver 30 receives the image data signal DATA and the data control signal CONT1, and outputs a data signal through an output channel of a plurality of data driving ICs. The data signal is transmitted to the plurality of data lines DL1 to DLm connected with the output channels.

The output channel of the data driver 30 and the data lines DL1 to DLm of the display unit 10 will be described with reference to FIG. 2.

Figure 2:
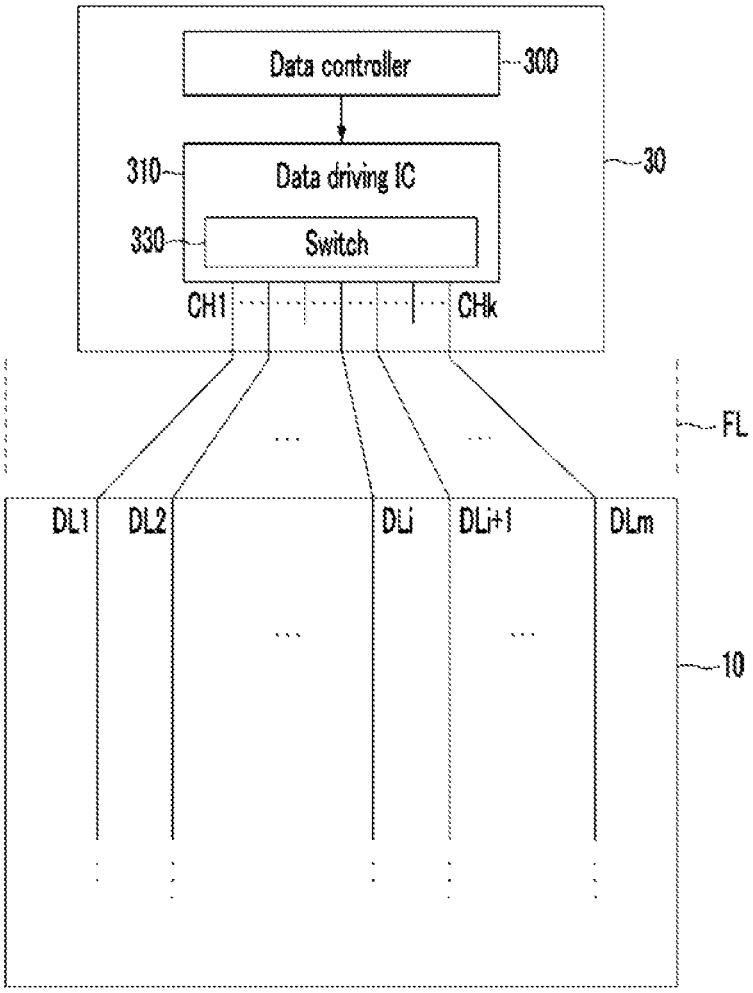
FIG. 2 is an exemplary view illustrating a connection state of a data driver and a display unit according to the exemplary embodiment in detail.

FIG. 2 is an exemplary view illustrating a connection state of the data driver 30 and the display unit 10 in detail according to the exemplary embodiment. As shown in the drawing, the data driver 30 may include a data driving IC 310 and a data controller 300.

A portion of the plurality of output channels CH1 to CHk of the data driving IC 310 may be connected with the corresponding data lines DL1 to DLm of the display unit 10 through fan-out wires FL.

For example, the number of output channels CH1 to CHk and the number of data lines DL1 to DLm may not be equal to each other. Additionally, the number of normal output channels and the number of dummy output channels may not be equal to the number of output channels. For example, the number of output channels CH1 to CHk may be 966, and the number of data lines DL1 to DLm disposed in the display unit 10 may be 720. For example, 126 output channels of the data driving IC 310 may operate as dummy output channels, and 720 output channels may operate as normal output channels. The 720 normal output channels 720 are connected with the 720 data lines DL1 to DLm, and data signals output from the 720 normal output channels may be transmitted to the data lines DL1 to DLm.

The data driving IC 310 may operate one of a plurality of channel modes according to the number of dummy output channels. For example, the data driver IC having 966 channels may operate using a first channel mode of a plurality of channel mode. In the first channel mode a data signal is transmitted through 966 normal output channels, a second channel mode in which a data signal is transmitted through 960 normal output channels and the other 6 output channels operate as dummy output channels, and a third channel mode in which a data signal is transmitted through 864 normal output channels and the other 102 output channels operate as dummy output channels. The arrangement of dummy output channels for operation with each channel mode may be included in the channel selection data and thus transmitted to the data controller 300.

A switch unit may include a plurality of switches corresponding to the plurality of output channels. Each switch is turned off or turned on to output a data signal to an output channel. For example, a switch unit 330 may be controlled to appropriately arrange the dummy output channels that are not connected with the data lines DL1 to DLm between normal output channels that are connected with the data lines DL1 to DLm.

The data controller 300 may generate output channel on/off data based on the channel selection data included in the input image data signal DATA. Further, the output channel on/off data is transmitted to the switch unit 330 such that the operation of a switch connected with a dummy output channel can be controlled.

The output channel on/off data may control switches according to the arrangement of the normal output channels and the dummy output channels. For example, switches connected to a first part of the output channels CH1 to CHk of the data driving IC 310 may be inactive and switches connected to a second part of the output channels, excluding the first part of the output channels, may be active. The output channels connected to the inactive switches may operate as dummy output channels. The dummy output channel may not output a dummy signal generated by dummy image data. The output channels connected with the active switches may operate as normal output channels. The normal output channel may output a data signal according to the image data.

The channel selection data transmitted to the data controller 300 includes information that controls the data driving IC 310 such that normal output channels and dummy output channels can be appropriately arranged. A portion of the plurality of output channels of the data driving IC may operate as a dummy output channel, and others, excluding the portion, may operate as normal output channels according to the channel selection data. The channel selection data will be described with reference to FIG. 3.

Figure 3:
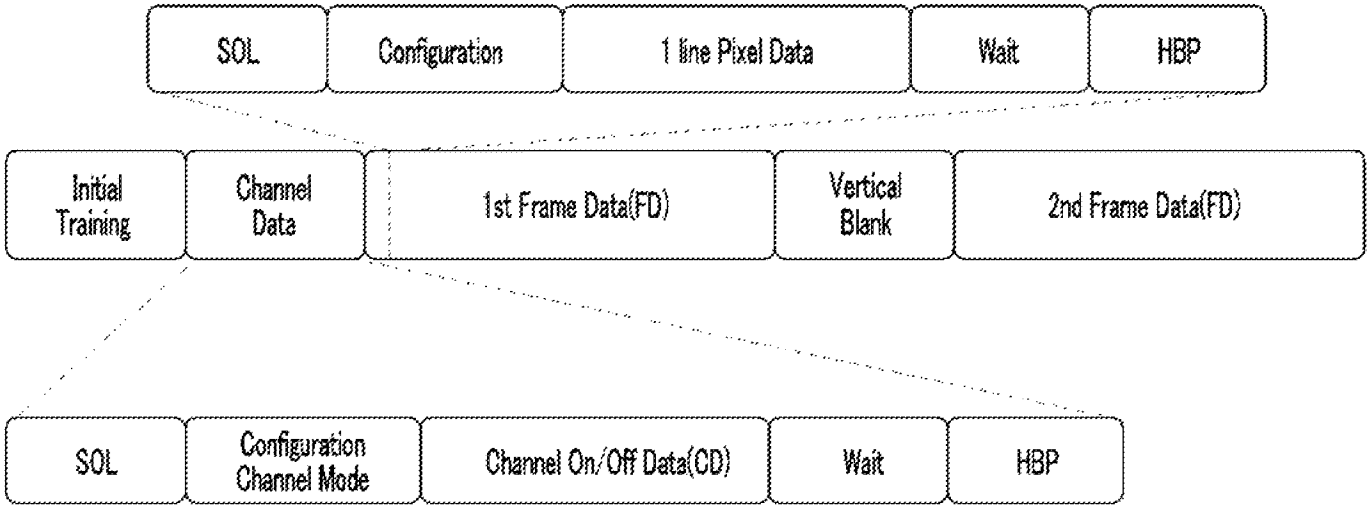
FIG. 3 is an exemplary view illustrating an image data signal according to the exemplary embodiment.

FIG. 3 is an exemplary view illustrating the image data signal DATA according to the exemplary embodiment. As shown in the drawing, a data sequence of the image data signal DATA may include channel selection data (Channel Data), a plurality of image data of one frame unit, and one or more piece of information.

The channel selection data (Channel Data) may be arranged in the data sequence prior to image data (FD) of one frame unit. The channel selection data may include a configuration channel mode and output channel on/off data (CD). In addition, the data is arranged between a line start signal (SOL) and standby signals (WAIT and HBP) indicating transmission standby time.

The configuration channel mode indicates the mode that the display device operates in to correspond to the resolution of the display unit. Each channel mode indicates a different proportion of output channels that operate in a normal mode or in a dummy mode. For example, a first display unit having a first resolution may operate in a first channel mode and the configuration channel mode may indicate the first channel mode. In the first channel mode a data signal may be transmitted through 966 normal output channels. In a further example, a second display unit having a second resolution may operate in a second channel mode and the configuration channel mode may indicate the second channel mode. In the second channel mode a data signal may be transmitted through 960 normal output channels and the other 6 output channels operate as dummy output channels.

Further, image data FD of one frame unit may include a plurality of data sequences including line start signals (SOL) indicating a transmission of data corresponding to one line, environment setting signals (Configuration) for updating latches 316 and 317 (refer to FIG. 4 and FIG. 6) included in the data driver IC 310, line image data (1 line Pixel Data) corresponding to one line, and standby signals (Wait and HBP) indicating transmission standby time.

In the line image data (1 line Pixel Data), image data and dummy image data may be arranged according to the channel selection data. In one line image data, a plurality of image data corresponding to the number of output channels of the data driving IC 310 are arranged. For example, when the data driving IC 310 having 966 output channels supplies a data signal through 864 data lines DL, the one line image data derived from the image information IS may arranged 864 image data and 102 dummy image data.

The data driver 30 receives the image data signal DATA including the channel selection data and selectively operating output channels will be described with reference to FIG. 4.

Figure 4:
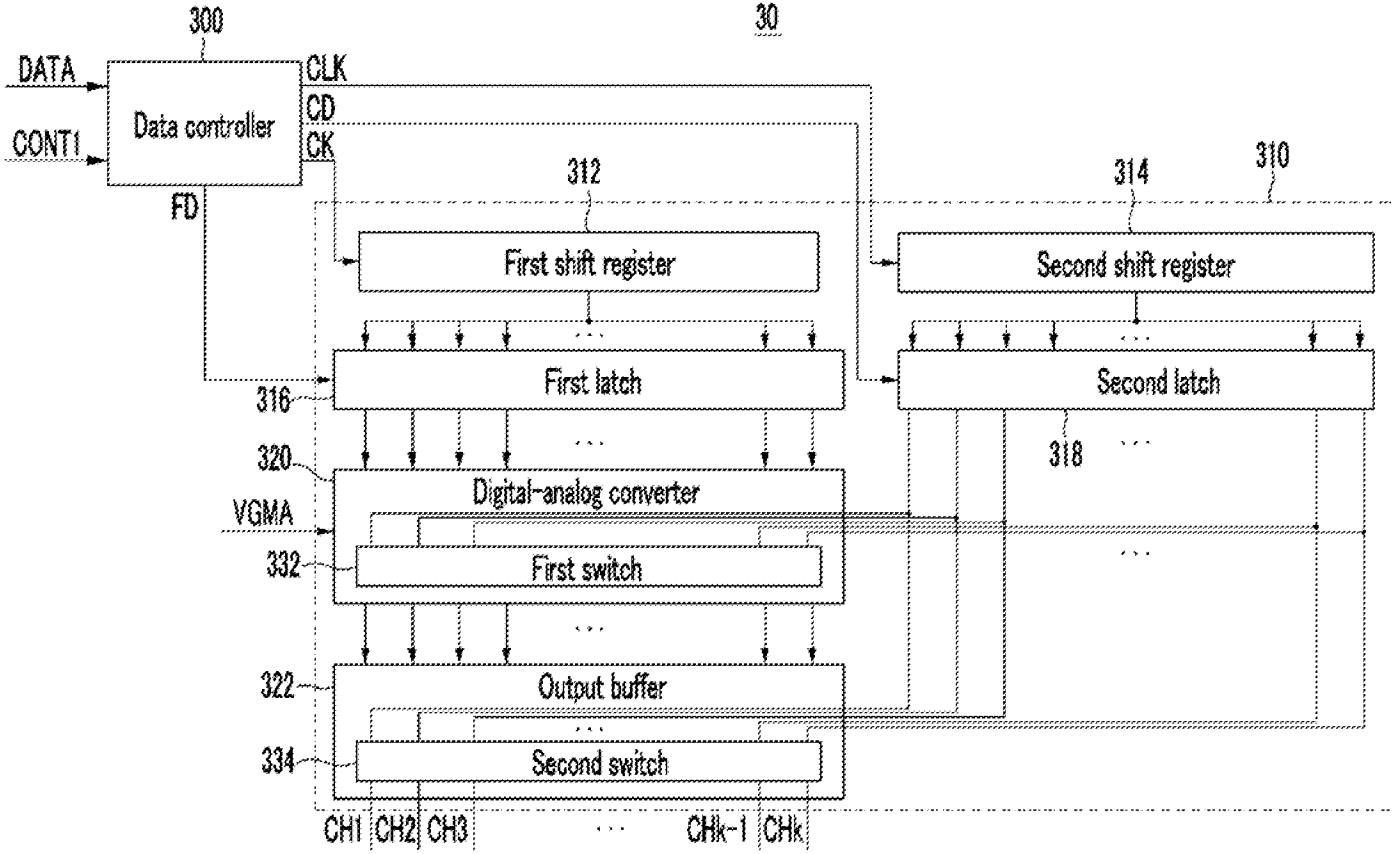
FIG. 4 is a block diagram of a data driver according to an exemplary embodiment.

FIG. 4 is a block diagram illustrating a data driver 30 according to a first exemplary embodiment. As shown in the drawing, the data driver 30 is connected with a data driving IC 310, and may transmit operation signals generated by a data control signal CONT1 and image data signal DATA to the data driving IC 310.

The data driving IC 310 includes a first shift register 312, a first latch 316, a digital-analog converter 320, an output buffer 322, a second shift register 314, and a second latch 318.

The data controller 300 generates image data FD of one frame unit, and provides the image data FD to the first latch 316 according to the image data signal DATA and the data control signal CONT1 provided from the signal controller 40. Further, the data controller 300 generates output channel on/off data CD, and provides the output channel on/off data CD to the second latch 318 according to the image data signal DATA and the data control signal CONT1.

In addition, the data controller 300 transmits a plurality of data clock signals CK and CLK included in the data control signal CONT1 to the first shift register 312 and the second shift register 314. For example, a first data clock signal CK and a second data clock signal CLK, each having a different enable cycle, are respectively transmitted to the first shift register 312 and the second shift register 314.

The first shift register 312 provides a sampling signal to the first latch 316. For example, the first shift register 312 shifts a horizontal start signal responding to the first data clock signal CK input from the signal controller 40, and provides the shifted signal as a first sampling signal to the first latch 316.

The first latch 316 is formed of a plurality of unit latches, and samples and latches image data (FD) of one frame unit, provided from the data controller 300 responding to the first sampling signal, and outputs the latched image data (FD) of one frame unit. For example, the first latch 316 latches the image data (FD) of one frame unit with a unit of six channels. Here, the first latch 316 outputs image data (FD) of one frame unit with one horizontal line unit in general. For example, one horizontal line unit may be one pixel row unit.

The second shift register 314 provides a second sampling signal to the second latch 318. For example, the second shift register 314 shifts a horizontal start signal responding to the second data clock signal CLK input from the signal controller 40, and provides the shifted horizontal start signal as a second sampling signal to the second latch 318.

The second latch 318 is formed from a plurality of unit latches, and samples and latches output channel on/off data (CD) provided from the data controller 300 responding to the second sampling signal. The second latch 318 outputs the latched output channel on/off data (CD). For example, the second latch 318 latches the output channel on/off data (CD) with a unit of one channel. Here, the second latch 318 outputs output channel on/off data (CD) with a unit of one horizontal line.

The enable period corresponding to the first sampling signal and the second sampling signal may vary based on the number of normal output channels and dummy output channels. The enable period for the first sampling signal and the second sampling signal may.

A sampling of the first latch 316 and the second latch 318 will now be described with reference to FIG. 5 according to an exemplary embodiment.

Figure 5:
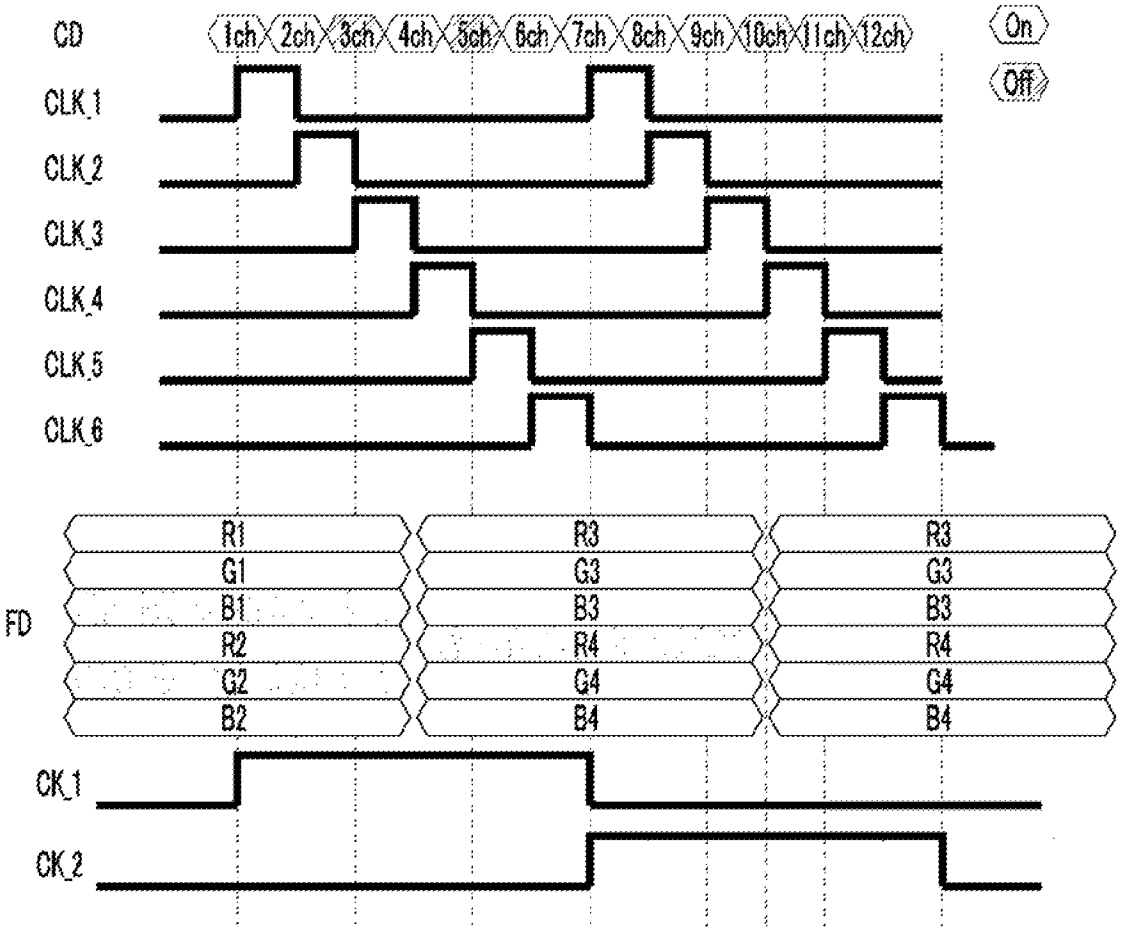
FIG. 5 is a timing diagram related with the data driver of FIG. 4.

FIG. 5 is a timing diagram related to the data driver 30 of FIG. 4. As shown in the drawing, image data (FD) of one frame unit may be latched with a unit of a plurality of channels according to first sampling signals CK_1 and CK_2. In addition, the output channel on/off data (CD) may be latched with a unit of one channel according to second sampling signals CLK_1 to CLK_6.

For example, unit latches of the first latch 316 latch image data (FD) of one frame unit corresponding to six channels. In addition, unit latches of the second latch 318 latch channel on/off data (CD) corresponding to one channel. For example, an enable period of the first sampling signals CK_1 and CK_2 may be 6 times an enable period of the second sampling signals CLK_1 to CLK_6.

For example, arrangement of the normal output channels and the dummy output channels included in the output channel on/off data (CD) and arrangement of image data and dummy image data included in the frame image data may not be equal to each other.

Image data (FD) of one frame unit, latched in the first latch 316, is transmitted to the digital-analog converter 320, and the output channel on/off data (CD), latched in the second latch 318, is transmitted to the first switch 332 and the second switch 334 of the digital-analog converter 320.

The digital-analog converter 320 receives image data FD of one frame unit from the first latch 316, and converts the image data FD into an analog data signal (e.g., a data voltage) based on a plurality of gamma reference voltages VGMA.

For example, the digital-analog converter 320 converts dummy image data included in the image data FD of one frame unit supplied from the first latch 316 to a dummy signal. The dummy signal may include an analog data signal corresponding to the lowermost gray.

For example, as shown in FIG. 5, the image data FD of one frame unit provided from the first latch 316 includes dummy image data corresponding to a third output channel CH3, a fifth output channel CH5, and a tenth output channel CH10. The digital-analog converter 320 converts dummy image data corresponding to the third output channel CH3, the fifth output channel CH5, and the tenth output channel CH10 to an analog data signal corresponding to the lowermost gray.

The digital-analog converter 320 may include a first switch unit 332 including a plurality of switches corresponding to at least one output channel. The switches of the first switch unit 332 are turned on or turned off according to output channel on/off data CD provided from the second latch 318.

The switches of the first switch unit 332 may be turned on or turned off to correspond to normal output channels and dummy output channels arranged in the output channel on/off data CD.

For example, the data driving IC 310 may include a first output channel CH1 to a k-th output channel CHk, and the first switch unit 332 may include a first switch to a k-th switch corresponding to the first output channel CH1 to the k-th output channel CHk respectively. The first switch CH1 to the k-th switch CHk may operate the corresponding output channels as normal output channels or dummy output channels. As shown in the arrangement of the normal output channels and the dummy output channels of the output channel on/off data CD of FIG. 5, the third, fifth, and tenth switches of the first switch unit 332 may be turned off. The third, fifth and tenth switches correspond to the third output channel CH3, the fifth output channel CH5, and the tenth output channel CH10 and may operate as dummy output channels. Then, analog data signals corresponding to the third output channel CH3, the fifth output channel CH5, and the tenth output channel CH10 may not be transmitted to the output buffer 322. Accordingly, the third output channel CH3, the fifth output channel CH5, and the tenth output channel CH10 may operate as dummy output channels.

The output buffer 322 is formed of a plurality of unit output buffers, and buffers the analog data signal provided from the digital-analog converter 320 and outputs the buffered analog data signal to the output channels CH1 to CHk.

The output buffer 322 may include a second switch unit 334 including a plurality of switches respectively corresponding to the plurality of unit output buffers. The switches of the second switch unit 334 are turned on or turned off according to output channel on/off data CD provided from the second latch 318.

For example, the second switch unit 334 may include a first switch to a k-th switch respectively corresponding to a first output channel CH1 to a k-th output channel CHk. The first switch to the k-th switch are respectively connected to the corresponding output channels among the first output channel CH1 to the k-th output channel CHk to operate the respective output channels as normal output channels or dummy output channels. As shown in the arrangement of the normal output channels and the dummy output channels of the output channel on/off data CD of FIG. 5, the third, fifth, and tenth switches of the second switch unit 334 may be turned off The third, fifth and tenth switches correspond to the third output channel CH3, the fifth output channel CH5, and the tenth output channel CH10 and may operate as dummy output channels. The analog data signals corresponding to the third output channel CH3, the fifth output channel CH5, and the tenth output channel CH10 may not be output to the third output channel CH3, the fifth output channel CH5, and the tenth output channel CH10. Thus, the third output channel CH3, the fifth output channel CH5, and the tenth output channel CH10 may operate as dummy output channels.

For example, the data driving IC 310 of the first exemplary embodiment may output a data signal through a normal output channel by controlling switches according to output channel on/off data CD. The switches correspond to dummy output channels among output channels.

Figure 6:
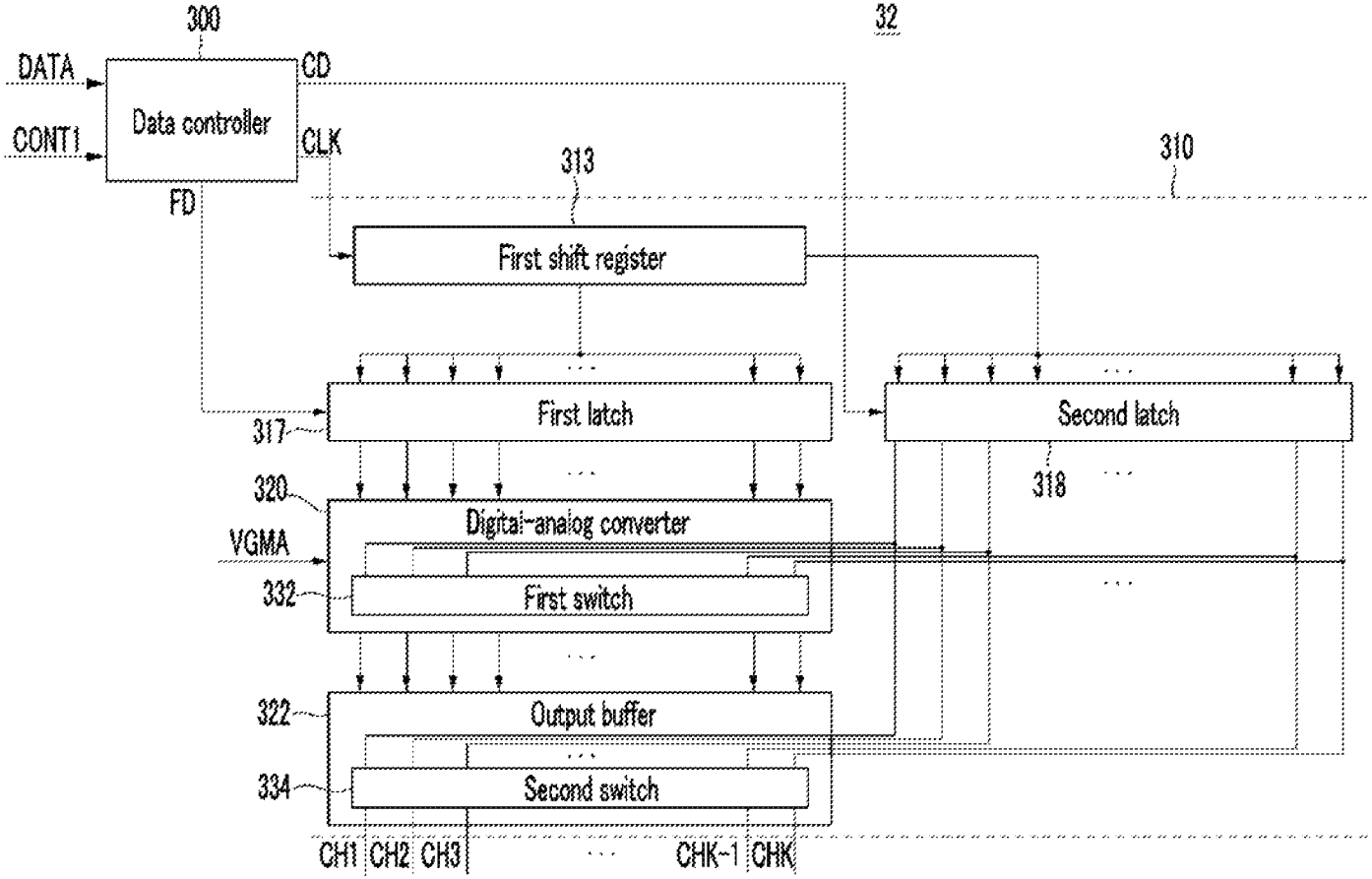
FIG. 6 is a block diagram illustrating a data driver according to an exemplary embodiment.

Referring to FIG. 6, a data driver 32 according to a second exemplary embodiment will now be described.

FIG. 6 is a block diagram of a data driver 32 according to a second exemplary embodiment.

As shown in the drawing, a data controller 300 is connected with a data driving IC 310 and transmits operation signals generated by a data control signal CONT1 and an image data signal DATA to the data driving IC 310.

The data driving IC 310 includes a first shift register 313, a first latch 317, a digital-analog converter 320, an output buffer 322, and a second latch 318.

The data controller 300 generates image data FD of one frame unit and provides the image data FD to the first latch 317 according to the image data signal DATA and the data control signal CONT1 provided from the signal controller 40. Further, the data controller 300 generates output channel on/off data CD and provides the output channel on/off data CD to the second latch 318 according to the image data signal DATA and the data control signal CONT1.

In addition, the data controller 300 transmits a data clock signal CLK included in the data control signal CONT1 to the first shift register 313.

The first shift register 313 provides a sampling signal to the first latch 317 and the second latch 318. For example, the first shift register 313 shifts a horizontal start signal responding to the data control signal CONT1 input from the signal controller 40, and provides the shifted horizontal start signal as a sampling signal to the first latch 317 and the second latch 318.

The first latch 317 is formed of a plurality of unit latches, samples and latches image data FD of one frame unit provided from the data controller 300 responding to the sampling signal, and outputs the latched image data FD of one frame unit. For example, the first latch 317 latches image data FD of one frame unit for substantially every single channel unit. Here, the first latch 317 outputs image data FD of one frame unit for each horizontal line unit, in general.

The second latch 318 is formed of a plurality of unit latches, and samples and latches output channel on/off data CD provided from the data controller 300 responding to the sampling signal, and outputs the latched output channel on/off data CD. For example, the second latch 318 latches the output channel on/off data CD for substantially every signal channel unit. Here, the second latch 318 outputs the output channel on/off data CD for each horizontal line unit, in general.

Sampling of the first and second latches 317 and 318 will be described with reference to FIG. 7.

Figure 7:
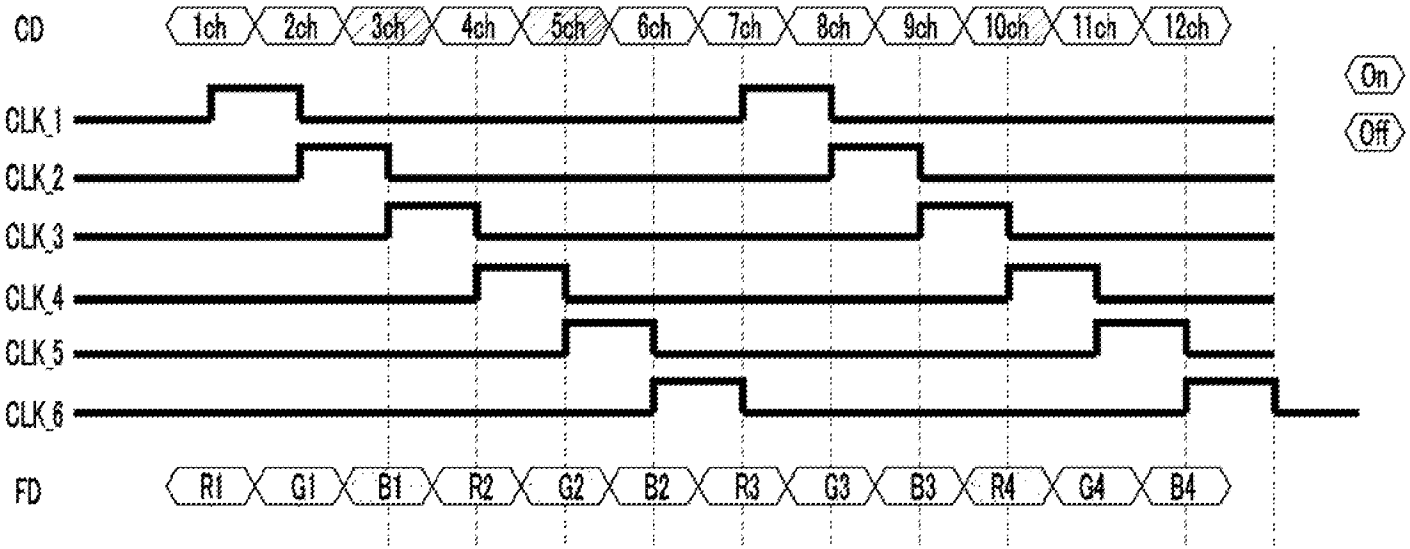
FIG. 7 is a timing diagram related with the data driver of FIG. 5.

FIG. 7 is a timing diagram related with the data driver 32 of FIG. 6. As shown in the drawing, image data FD of one frame unit and output channel on/off data CD may be latched for each channel unit according to the sampling signal CLK_1 to CLK_6.

For example, the unit latches of the first latch 317 latch image data corresponding to a single channel. In addition, the unit latches of the second latch 318 latch output channel on/off data CD corresponding to a single channel. For example, the first latch 317 and the second latch 318 may latch image data and output channel on/off data CD during an enable period of the sampling signal CLK_1 to CLK_6.

For example, an arrangement of normal output channels and dummy output channels included in the output channel on/off data CD and an arrangement of image data and dummy image data included in image data FD of one frame unit may match each other.

The image data FD of one frame unit, latched by the first latch 318, is transmitted to the digital-analog converter 320, and the output channel on/off data CD latched by the second latch 318 is transmitted to the first switch unit 332 and the second switch unit 334.

The digital-analog converter 320 receives the image data FD of one frame unit, provided from the first latch 317, and converts the image data FD to an analog data signal (e.g., a data voltage) based on a plurality of gamma reference voltages VGMA.

For example, the digital-analog converter 320 receives dummy image data included in the image data FD of one frame unit provided from the first latch 317 and converts the dummy image data to a dummy signal. The dummy signal may include an analog data signal corresponding to the lowermost gray.

For example, as shown in FIG. 7, the image data FD of one frame unit provided from the first latch 317 includes dummy image data corresponding to a third output channel CH3, a fifth output channel CH5, and a tenth output channel CH10. Then, the digital-analog converter 320 converts dummy image data corresponding to the third output channel CH3, the fifth output channel CH5, and the tenth output channel CH10 to an analog data signal corresponding to the lowermost gray.

Meanwhile, the digital-analog converter 320 may include a first switch unit 332 including a plurality of switches corresponding to at least one output channel. The switches of the first switch unit 332 are turned on or turned off according to output channel on/off data CD provided from the second latch 318.

The switches of the first switch unit 332 may be turned on or turned off to correspond to normal output channels and dummy output channels arranged in the output channel on/off data CD.

For example, the data driving IC 310 may include a first output channel CH1 to a k-th output channel CHk, and the first switch unit 332 may include a first switch to a k-th switch. The first switch CH1 to the k-th switch CHk may operate the corresponding output channels as normal output channels or dummy output channels.

As shown in the arrangement of the normal output channels and the dummy output channels of the output channel on/off data CD of FIG. 7, the third, fifth, and tenth switches of the first switch unit 332 may be turned off. The third, fifth and tenth switches correspond to the third output channel CH3, the fifth output channel CH5, and the tenth output channel CH10 and may operate as dummy output channels. Then, analog data signals corresponding to the third output channel CH3, the fifth output channel CH5, and the tenth output channel CH10 may not be transmitted to an output buffer 322. Accordingly, the third output channel CH3, the fifth output channel CH5, and the tenth output channel CH10 may operate as dummy output channels.

The output buffer 322 is formed of a plurality of unit output buffers, and buffers the analog data signal provided from the digital-analog converter 320 and outputs the buffered analog data signal to the output channels CH1 to CHk.

The output buffer 322 may include a second switch unit 334 including a plurality of switches respectively corresponding to the plurality of unit output buffers. The switches of the second switch unit 334 are turned on or turned off according to output channel on/off data CD provided from the second latch 318.

For example, the second switch unit 334 may include a first switch to a k-th switch. The first switch to the k-th switch are respectively connected to the corresponding output channels among the first output channel CH1 to the k-th output channel CHk to operate the respective output channels as normal output channels or dummy output channels. As shown in the arrangement of the normal output channels and the dummy output channels of the output channel on/off data CD of FIG. 7, the third, fifth, and tenth switches of the second switch unit 334 may be turned. The third, fifth and tenth switches correspond to the the third output channel CH3, the fifth output channel CH5, and the tenth output channel CH10 and may operate as dummy output channels. Then, analog data signals corresponding to the third output channel CH3, the fifth output channel CH5, and the tenth output channel CH10 may not be output to the third output channel CH3, the fifth output channel CH5, and the tenth output channel CH10. Thus, the third output channel CH3, the fifth output channel CH5, and the tenth output channel CH10 may operate as dummy output channels.

For example, the data driving IC 310 of the second exemplary embodiment may output a data signal through a normal output channel by controlling switches corresponding to dummy output channels among output channels according to output channel on/off data CD.

Next, an output channel arrangement of the data driver 30 according to the exemplary embodiment of the preset invention will be described with reference to FIG. 8, FIG. 9, and FIG. 10.

Figure 8:
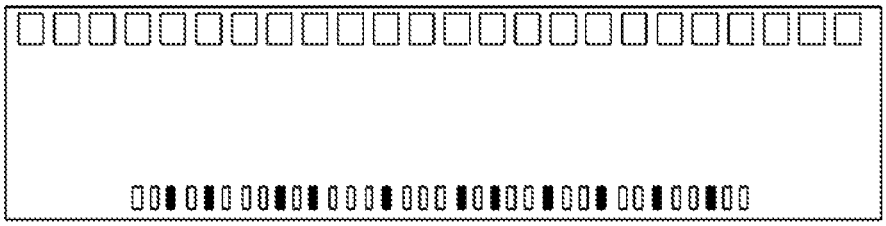
FIG. 8, FIG. 9, and FIG. 10 are exemplary views schematically illustrating a normal output channel and a dummy output channel of the data driver according to the exemplary embodiment.
Figure 9:
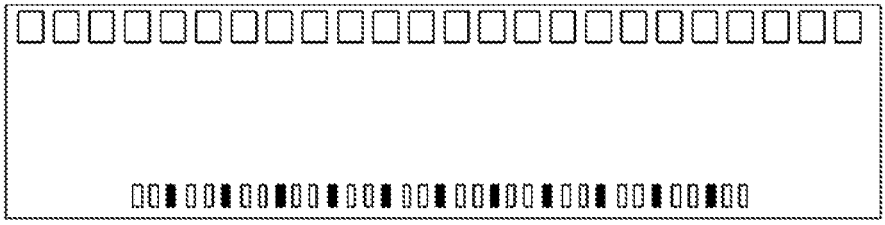
Figure 10:
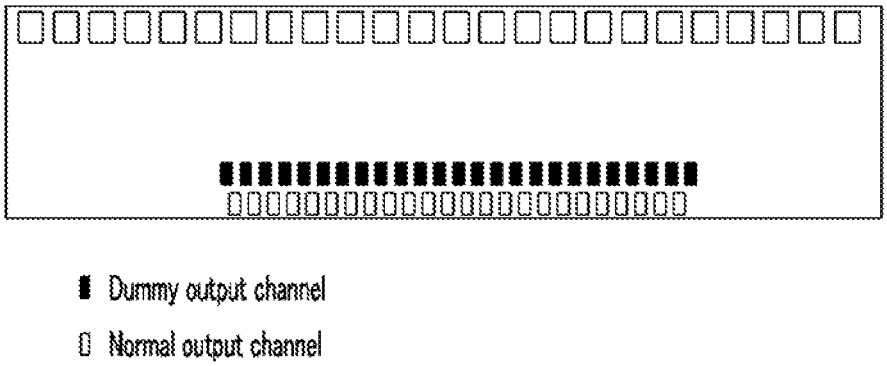

FIG. 8, FIG. 9, and FIG. 10 are exemplary diagrams schematically illustrating normal output channels and dummy output channels of the data driver 30 according to the exemplary embodiment. As shown in FIG. 8 and FIG. 9, the dummy output channels may be appropriately arranged between normal output channels.

As shown in FIG. 8, at least one normal output channel is inserted between every two dummy output channels in the arrangement of the dummy output channels and the normal output channels.

In addition, as shown in FIG. 9, a given number of normal output channels and a given number of dummy output channels may be alternately arranged. For example, a first number of normal output channels and a second number of dummy output channels may be alternately arranged, and the first number is greater than the second number. In a further example, the dummy output channels and the normal output channels may be alternately arranged in substantially the same order, respectively.

As shown in FIG. 10, the data driver 30 may include two rows of output channels. For example, output channels of a first row may operate as dummy output channels, and output channels of a second row may operate as normal output channels. In a further example, the output channels of the first row and the output channels of the second row may be arranged as shown in FIG. 8 or FIG. 9.

In the data driver 30 and the display device using the data driver 30 according to the exemplary embodiments, dummy output channels and normal output channels are arranged such that resistance of fan-out wires FL of the display unit 10 connected with the normal output channels are substantially equal to each other. Further, a noise occurrence may be reduced when a data signal is not output to the dummy output channel in the data driver 30 and the display device using the data driver. Accordingly, when data signals having the substantially same intensity are output to the normal output channels, pixels PX connected to the normal output channels can receive the data signals having substantially the same intensity.

Further, in the data driver 30 and the display device using the data driver 30 according to the exemplary embodiments, a number of dummy output channels can be easily controlled according to a resolution of the display unit 10 so that a display device 10 having a unique resolution can be driven by using one type of data driver 30. Accordingly, the data driver 30 and the display device using the data driver 30 according to the exemplary embodiments can reduce the manufacturing cost of a display device.

Further, in the data driver 30 and the display device using the data driver 30 according to the exemplary embodiments, a data signal corresponding to a dummy output channel is converted to an analog data signal corresponding to the lowermost gray, and accordingly, power consumption can be reduced.

While this disclosure has been described in connection with what is presently considered to be practical exemplary embodiments, it is to be understood that the exemplary embodiments of the invention is not limited to the disclosed embodiments, but, on the contrary, is intended to cover various modifications and equivalent arrangements included within the spirit and scope of the appended claims. Therefore, it will be appreciated by those skilled in the art that various modifications are made and other equivalent embodiments are available. Furthermore, those skilled in the art can modify the sequence of the steps of the method described in the present specification depending on the process environment or equipment.

What is claimed is:

1. A data driver comprising:

a plurality of first output channels connected to a plurality of data lines;

a plurality of second output channels; and a data driving integrated circuit IC that receives image data of one frame unit according to an image data signal and a data control signal, receives an output channel on/off data based on a channel selection data, and generates a plurality of data signals and a plurality of dummy signals according to the image data of one frame unit, and that switches a plurality of first switches transmitting the plurality of data signals to the plurality of first output channels and a plurality of second switches transmitting the plurality of dummy signals to the plurality of second output channels, wherein the image data signal includes the channel selection data related to the plurality of first output channels and the plurality of second output channels, wherein the channel selection data comprises information for arranging the plurality of first output channels and the plurality of second output channels, wherein the channel selection data is arranged in the data sequence prior to the image data of one frame unit including a plurality of line image data, and wherein normal image data and dummy image data are arranged in each line image data, according to the channel selection data, wherein the data driving IC comprises:

a first latch that latches the image data of one frame unit to at least one channel unit and that outputs a latched image data;

a second latch that latches the output channel on/off data and that outputs a latched output channel on/off data to the plurality of second switches; and a digital-analog converter that converts the latched image data into the plurality of data signals and the plurality of dummy signals and that outputs the plurality of data signals and the plurality of dummy signals, and including the plurality of first switches.

2. The data driver of claim 1, wherein the data driving IC further comprises an output buffer that buffers and that outputs the plurality of data signals and the plurality of dummy signals, and including the plurality of second switches.

3. The data driver of claim 2, wherein the plurality of second switches are driven to not output the plurality of dummy signals according to the output channel on/off data transmitted from the second latch.

4. The data driver of claim 2, wherein the data driving IC further comprises:

a first shift register that outputs a first sampling signal to the first latch; and a second shift register that outputs a second sampling signal, wherein an enable period is different from that of the first sampling signal to the second latch.

5. The data driver of claim 4, wherein the enable period of the first sampling signal and the enable period of the second sampling signal are determined according to a number of the first output channels and the second output channels.

6. The data driver of claim 2, wherein the data driving IC further comprises a shift register that outputs a sampling signal to the first latch and the second latch, and the first latch and the second latch perform latching for each channel.

7. A display device comprising:

a display unit including a plurality of pixels, each pixel is connected to a corresponding data line among a plurality of data lines;

a data driver that generates a plurality of data signals transmitted to a plurality of first output channels connected to the plurality of data lines and a plurality of dummy signals transmitted to a plurality of second output channels; and wherein the data driver comprises a data driving integrated circuit IC that receives image data for one frame unit, receives channel on/off data based on a channel selection data included in an image data signal, generates the plurality of data signals and the plurality of dummy signals according to the image data of one frame unit, and switching a plurality of first switches transmitting the plurality of data signals to the plurality of first output channels and a plurality of second switches transmitting the plurality of dummy signals to the plurality of second output channels, wherein the channel selection data comprises information for arranging the plurality of first output channels and the plurality of second output channels, wherein the channel selection data is arranged in the data sequence prior to the image data of one frame unit including a plurality of line image data, and wherein normal image data and dummy image data are arranged in each line image data, according to the channel selection data, wherein the data driving IC comprises:

a first latch that latches the image data of one frame unit to at least one channel unit and that outputs a latched image data;

a second latch that latches the output channel on/off data and that outputs a latched output channel on/off data to the plurality of second switches; and a digital-analog converter that converts the latched image data into the plurality of data signals and the plurality of dummy signals and that outputs the plurality of data signals and the plurality of dummy signals, and including the plurality of first switches.

8. The display device of claim 7, wherein the signal controller generates image data based on an input image information and arranged image data for each pixel unit, and that generates the image data signal by locating dummy image data in the plurality of pixels corresponding to the plurality of second output channels according to the channel selection data.

9. The display device of claim 8, wherein the signal controller outputs the image data signal, wherein the image data signal that includes the channel selection data is arranged prior to the image data and the dummy image data.

10. The display device of claim 8, wherein the channel selection data comprises information for arranging the plurality of first output channels and the plurality of second output channels.

11. The display device of claim 8, wherein the data driving IC further comprises an output buffer that buffers and outputs the plurality of data signals and the plurality of dummy signals, and including the plurality of first switches and the plurality of second switches.

12. The display device of claim 11, wherein the plurality of second switches are driven to not output the plurality of dummy signals according to the output channel on/off data transmitted from the second latch.

13. The display device of claim 11, wherein the data driving IC further comprises:

a first shift register that outputs a first sampling signal to the first latch; and a second shift register that outputs a second sampling signal of which an enable period is different from that of the first sampling signal to the second latch.

14. The display device of claim 13, wherein the enable period of the first sampling signal and the enable period of the second sampling signal are determined according to a number of the first output channels and the second output channels.

15. The display device of claim 11, wherein the data driving IC further comprises a shift register that outputs a sampling signal to the first latch and the second latch, and the first latch and the second latch perform latching for each channel.

16. The data driver of claim 1, wherein the image data of one frame unit and the channel selection data are generated from the image data signal and the data control signal.

17. The display device of claim 7, wherein:

the image data signal including channel selection data related to the plurality of first output channels and the plurality of second output channels and a data control signal to the data driver is generated from a signal controller implemented in an integrated circuit having a memory therein.

* * * * *